US010569394B2

(12) United States Patent
Seith et al.

(10) Patent No.: US 10,569,394 B2
(45) Date of Patent: Feb. 25, 2020

(54) ROTARY IMPACT DEVICE

(71) Applicant: INGERSOLL-RAND COMPANY, Davidson, NC (US)

(72) Inventors: Warren Andrew Seith, Bethlehem, PA (US); Ryan Scott Amend, Bethlehem, PA (US)

(73) Assignee: Ingersoll-Rand Company, Davidson, NC (US)

( * ) Notice: Subject to any disclaimer, the term of this patent is extended or adjusted under 35 U.S.C. 154(b) by 377 days.

(21) Appl. No.: 15/400,706

(22) Filed: Jan. 6, 2017

(65) Prior Publication Data

US 2017/0113334 A1 Apr. 27, 2017

Related U.S. Application Data

(63) Continuation of application No. 13/080,030, filed on Apr. 5, 2011, now Pat. No. 9,566,692.

(51) Int. Cl.

| | |
|---|---|
| ***B25B 21/02*** | (2006.01) |
| ***B25B 13/06*** | (2006.01) |
| ***B25B 23/00*** | (2006.01) |

(52) U.S. Cl.

CPC ..... *B25B 21/02* (2013.01); *B25B 13/06* (2013.01); *B25B 21/026* (2013.01); *B25B 23/0035* (2013.01)

(58) Field of Classification Search

CPC ... B25B 21/02; B25B 23/0035; B25B 21/026; B25B 13/06

USPC ..... 173/1, 2, 176, 179, 183, 217

See application file for complete search history.

(56) References Cited

U.S. PATENT DOCUMENTS

| | | | |
|---|---|---|---|
| 2,301,860 | A | 11/1942 | Doane |
| 2,969,660 | A | 1/1961 | Dale et al. |
| 3,180,435 | A | 4/1965 | McHenry |
| 3,982,419 | A | 9/1976 | Boys |
| 4,157,120 | A | 6/1979 | Anderson |
| D338,146 | S | 8/1993 | Gramera |

(Continued)

FOREIGN PATENT DOCUMENTS

| | | |
|---|---|---|
| CN | 1765589 | 5/2006 |
| DE | 940877 | 3/1956 |

(Continued)

OTHER PUBLICATIONS

International Search Report dated Jun. 20, 2012 from International Patent Application No. PCT/US2012/032116 filed Apr. 4, 2012.

(Continued)

*Primary Examiner* — Robert F Long

(74) *Attorney, Agent, or Firm* — Jones IP Group; Wayne A. Jones

(57) ABSTRACT

The present invention provides methods and systems for a rotary impact device having an annular exterior surface for use with an impact wrench for providing torque to a fastener. The rotary impact device includes an input member having an input recess for receiving the anvil of the impact wrench, an output member having an output recess for receiving the fastener, and an inertia member. The inertia member is stationary and positioned on the exterior surface of the rotary impact device for increasing the torque applied to the fastener.

20 Claims, 7 Drawing Sheets

(56) References Cited

U.S. PATENT DOCUMENTS

| | | | | |
|---|---|---|---|---|
| 5,328,308 | A | 7/1994 | Ducker, III et al. | |
| 5,361,851 | A * | 11/1994 | Fox | B25F 5/021 173/170 |
| 5,598,892 | A * | 2/1997 | Fox | B25F 5/021 173/170 |
| 5,845,718 | A * | 12/1998 | Cooper | B23Q 5/027 173/176 |
| 5,848,655 | A * | 12/1998 | Cooper | B25B 21/00 173/176 |
| 6,196,332 | B1 * | 3/2001 | Albert | B25B 21/00 173/176 |
| 9,463,557 | B2 | 10/2016 | Seith et al. | |
| 9,469,017 | B2 | 10/2016 | Seith et al. | |
| 9,566,692 | B2 | 2/2017 | Seith et al. | |
| 2002/0185288 | A1 * | 12/2002 | Hanke | B25D 17/24 173/201 |
| 2010/0000749 | A1 * | 1/2010 | Andel | B25B 21/02 173/48 |
| 2010/0000750 | A1 | 1/2010 | Andel | |
| 2011/0056714 | A1 | 3/2011 | Elger et al. | |
| 2012/0132452 | A1 * | 5/2012 | Hoop | B25B 21/02 173/93.5 |
| 2012/0255749 | A1 | 10/2012 | Seith et al. | |
| 2013/0112448 | A1 * | 5/2013 | Profunser | B25B 21/026 173/93.5 |
| 2017/0028537 | A1 | 2/2017 | McClung et al. | |

FOREIGN PATENT DOCUMENTS

| | | | |
|---|---|---|---|
| GB | 930816 | A | 7/1963 |
| GB | 2443399 | A | 5/2008 |
| WO | 2011017066 | A1 | 2/2011 |

OTHER PUBLICATIONS

European Search Report dated May 26, 2015 from European Patent Application No. 12767994.2 filed Apr. 4, 2012.

Office Action dated Dec. 31, 2014 from Chinese Patent Application No. CN201280016835.5 filed Apr. 4, 2012.

International Preliminary Report on Patentability dated Nov. 19, 2013 from International Patent Application No. PCT/US2012/032116 filed Apr. 4, 2012.

Office Action dated Jul. 29, 2015 from Chinese Patent Application No. CN201280016835.5 filed Apr. 4, 2012.

International Search Report and Written Opinion dated Dec. 28, 2017 from International Patent Application No. PCT/US2017/055966 filed Oct. 10, 2017.

* cited by examiner

ROTARY IMPACT DEVICE

CROSS REFERENCE TO RELATED APPLICATION

This application is a continuation of U.S. patent application Ser. No. 13/080,030, filed Apr. 5, 2011, the disclosure of which is hereby incorporated entirely herein by reference.

FIELD OF THE INVENTION

The present invention relates generally to an improved rotary impact device, and more generally relates to an improved rotary impact device for use with an impact tool, such as an impact wrench, wherein the improved rotary impact device increases rotational inertia for expeditiously loosening or tightening a fastener.

BACKGROUND OF THE INVENTION

Impact tools, such as an impact wrench, are well known in the art. An impact wrench is one in which an output shaft or anvil is struck by a rotating mass or hammer. The output shaft is coupled to a fastener (e.g. bolt, screw, nut, etc.) to be tightened or loosened, and each strike of the hammer on the anvil applies torque to the fastener. Because of the nature of impact loading of an impact wrench compared to constant loading, such as a drill, an impact wrench can deliver higher torque to the fastener than a constant drive fastener driver.

Typically, a fastener engaging element, such as a socket, is engaged to the anvil of the impact wrench for tightening or loosening the fastener. Most fasteners have a polygonal portion for engaging a socket. The socket typically has a polygonal recess for receiving the polygonal portion of the fastener, thus resulting in a selectively secured mechanical connection. This connection or engagement of the socket to the anvil results in a spring effect. Additionally, there is a spring effect between the socket and the fastener. Therefore, it is desirable to increase the amount of torque applied by the socket to overcome the spring effect and to increase the net effect and improve performance of the impact wrench.

BRIEF SUMMARY OF THE INVENTION

The present invention is related to a rotary impact device that has an annular exterior surface and includes an input member, an output member, and an inertia member. The inertia member is stationary and positioned on the exterior surface of the rotary impact device for increasing the torque of the rotary impact device. The rotary impact device is composed of steel. The rotary impact device includes an output member with an outer edge that is beveled for guiding the fastener into the output recess.

The rotary impact device may also include an input recess disposed on the input member, wherein the input recess is generally square shaped.

The rotary impact device may also include an output recess disposed on the output member, wherein the output recess is polygonal-shaped.

In an alternative embodiment of the present invention, the rotary impact device includes an inertia member that includes a ring and at least two ribs having a first end and a second end. The first end of the rib is positioned on the exterior surface of the rotary impact device and the second end is positioned on the ring.

In another alternative embodiment of the present invention, the rotary impact device includes an inertia member that includes at least two bores that extend substantially longitudinally along the length of the inertia member.

In yet another alternative embodiment of the present invention, the rotary impact device has an annular exterior surface for use with an impact wrench for providing torque to a fastener. The rotary impact device includes an input member that has an input recess for receiving an anvil of the impact wrench, an output member that has an output recess for receiving the fastener, and an inertia member. The inertia member is stationary and positioned on the exterior surface of the rotary impact device for increasing torque applied to the fastener.

In yet another alternative embodiment of the present invention, a method for providing additional torque to a fastener, includes providing an impact wrench having a rotary hammer that rotates an anvil, a rotary impact device having an annular exterior surface. The rotary impact device includes an input member, an output member, and an inertia member. The inertia member is stationary and positioned on the exterior surface of the rotary impact device for increasing the torque applied to the fastener. The input member is engaged to the anvil of the impact wrench in a selectively secured arrangement. The output member is engaged to a fastener in a selectively secured arrangement. Power is provided to the impact wrench and the impact wrench is activated, causing the rotary hammer and anvil to rotate. The input member and output member rotate in conjunction with the rotation of the anvil.

In yet another alternative embodiment of the present invention, a method for providing additional torque to a fastener that includes providing an anvil with a square head and an input member having an input recess, wherein the input recess is generally square for receiving the square head of an anvil.

In yet another alternative embodiment of the present invention, a method for providing additional torque to a fastener that includes providing an output member that has an output recess and the output recess is polygonal shaped for receiving the fastener.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

Figure 1:
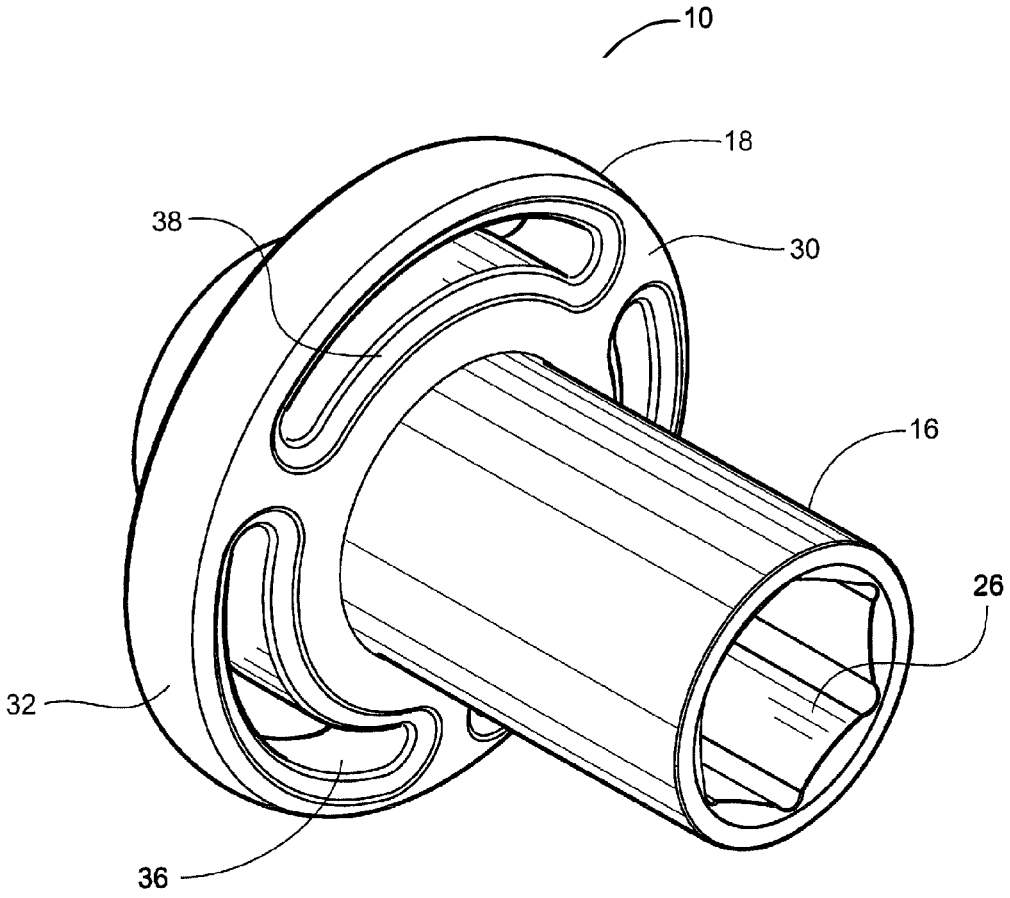
FIG. 1 is a perspective view of one embodiment of the rotary impact device.

Referring now specifically to the drawings, an improved rotary impact device is illustrated in FIG. 1 and is shown generally at reference numeral 10. The device 10 may be attached to and driven by an impact tool that is a source of high torque, such as an impact wrench 12. The device 10 is intended to be selectively secured to the impact wrench 12. The device 10 is preferably made of steel.

Figure 2:
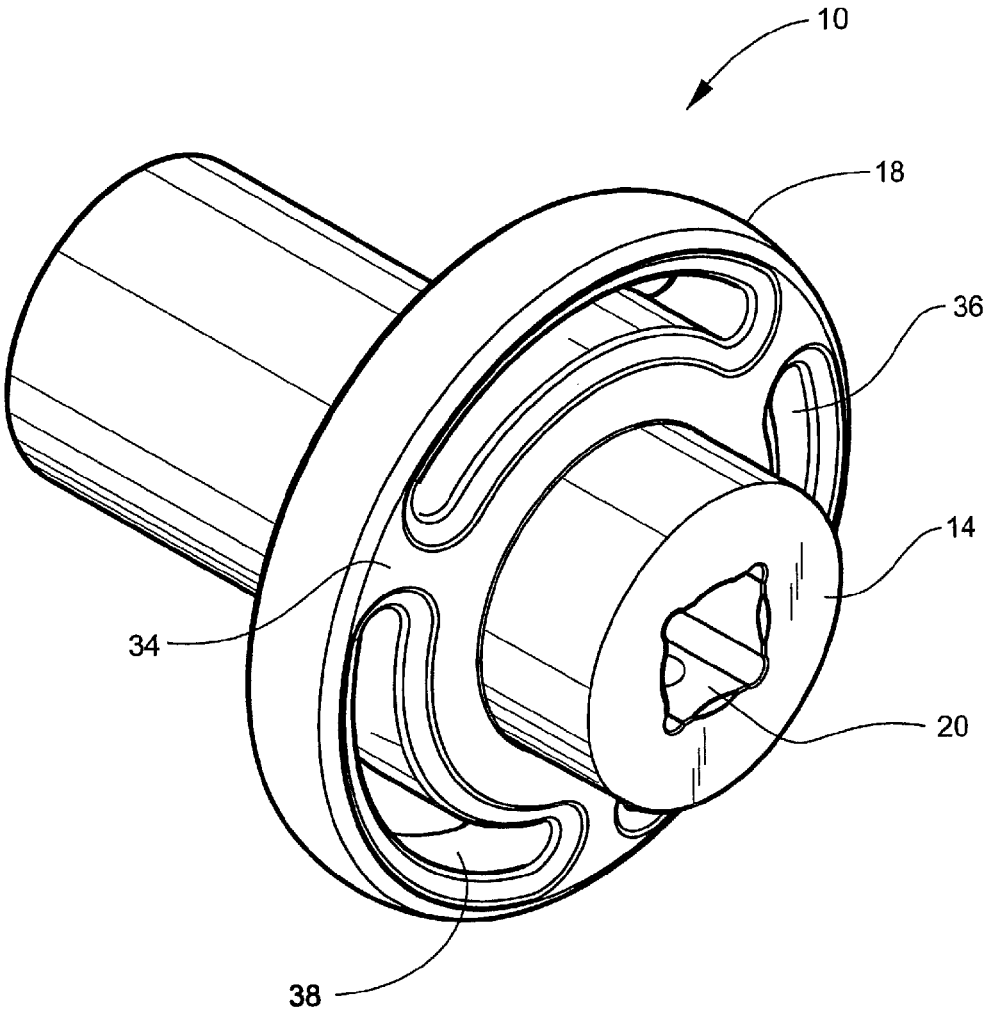
FIG. 2 is a another perspective view of the rotary impact device of FIG. 1.
Figure 3:
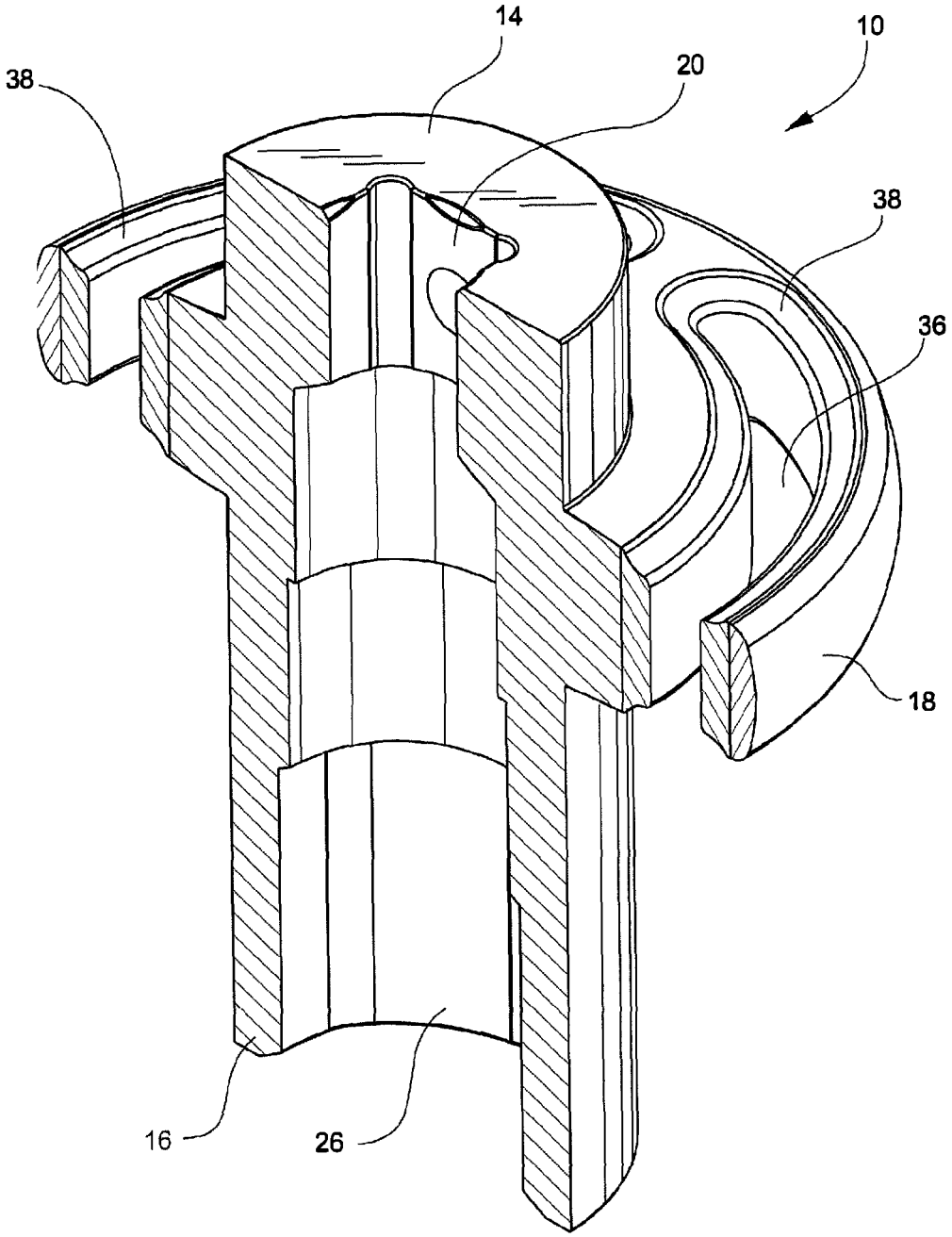
FIG. 3 is a cut-away view of the rotary impact device of FIGS. 1 and 2.
Figure 4:
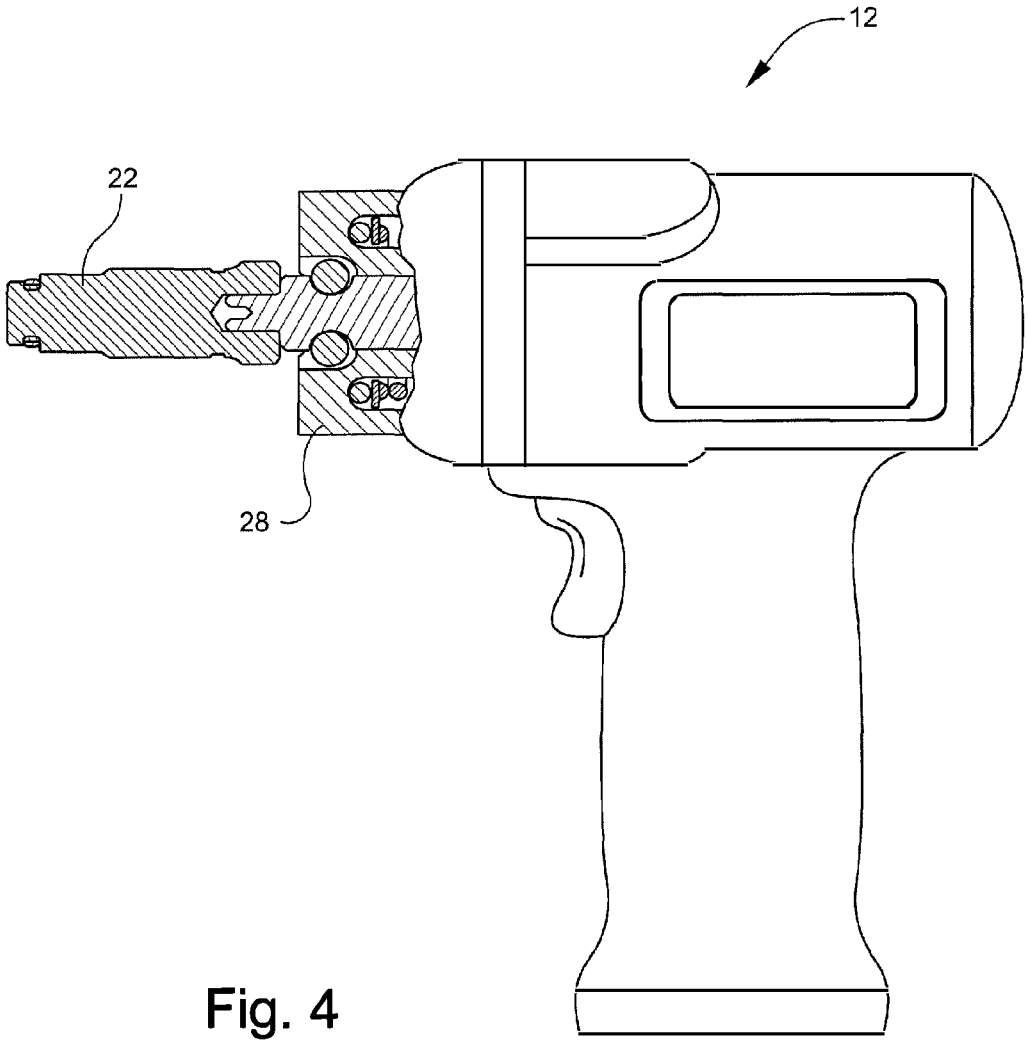
FIG. 4 is a partial cut-away side view of an impact wrench that may be used with the rotary impact device.

As illustrated in FIGS. 1, 2, and 3, the device 10 has an annular exterior surface and comprises an input member 14, an output member 16, and an inertia member 18. The input member 14 comprises an input recess 20 that extends partially along the axial direction of the device 10. Preferably, the input recess 20 is generally square shaped and is designed to be selectively secured to the anvil 22 of an impact wrench 12. However, other polygonal shapes may also be used. The anvil 22 includes a round body with a generally square drive head. The generally square drive head is designed to be received within the input recess 20 for forming a selectively secured arrangement.

The output member 16 includes an output recess 26. As illustrated in FIG. 1, the output recess 26 is a polygonal-shaped output recess 26 for receiving a fastener. The output recess 26 extends partially along the axial direction of the device 10. The fastener may be a bolt, screw, nut, etc. As is well known within the art, at least a portion of the fastener (e.g. the head of a bolt and the body of a screw) has a polygonal-shape that corresponds with the polygonal-shaped output recess 26. During use, the polygonal-shaped portion of the fastener is inserted into the polygonal-shaped output recess 26 for operation and is selectively secured to one another by friction fit. The fastener is preferably hexagonally shaped.

The inertia member 18 is substantially circular and is positioned on the exterior surface of the device 10. Preferably, the inertia member 18 is disposed on the exterior surface of the device 10 nearest the input member 14. However, the inertia member 18 may be disposed on any portion of the exterior surface of the device 10 as desired by the user. The inertia member 18 is preferably positioned as to not interfere with the engagement of the input member 14 to the anvil 22 and the engagement of the output member 16 to the fastener.

The device 10 is designed to be engaged to an impact wrench 12. As is well known by one of ordinary skill in the art, an impact wrench 12 is designed to receive a standard socket and designed to deliver high torque output with the exertion of a minimal amount of force by the user. The high torque output is accomplished by storing kinetic energy in a rotating mass, and then delivering the energy to an output shaft or anvil 22. Most impact wrenches 12 are driven by compressed air, but other power sources may be used such as electricity, hydraulic power, or battery operation.

In operation, the power is supplied to the motor that accelerates a rotating mass, commonly referred to as the hammer 28. As the hammer 28 rotates, kinetic energy is stored therein. The hammer 28 violently impacts the anvil 22, causing the anvil 22 to spin and create high torque upon impact. In other words, the kinetic energy of the hammer 28 is transferred to rotational energy in the anvil 22. Once the hammer 28 impacts the anvil 22, the hammer 28 of the impact wrench 12 is designed to freely spin again. Generally, the hammer 28 is able to slide and rotate on a shaft within the impact wrench 12. A biasing element, such as a spring, presses against the hammer 28 and forces the hammer 28 towards a downward position. In short, there are many hammer 28 designs, but it is important that the hammer 28 spin freely, impact the anvil 22, and then freely spin again after impact. In some impact wrench 12 designs, the hammer 28 drives the anvil 22 once per revolution. However, there are other impact wrench 12 designs where the hammer 28 drives the anvil 22 twice per revolution. There are many designs of an impact wrench 12 and most any impact wrench 12 may be selectively secured with the device 10 of the present invention.

The output torque of the impact wrench 12 is difficult to measure, since the impact by the hammer 28 on the anvil 22 is a short impact force. In other words, the impact wrench 12 delivers a fixed amount of energy with each impact by the hammer 28, rather than a fixed torque. Therefore, the actual output torque of the impact wrench 12 changes depending upon the operation. The anvil 22 is designed to be selectively secured to a device 10. This engagement or connection of the anvil 22 to the device 10 results in a spring effect when in operation. This spring effect stores energy and releases energy. It is desirable to mitigate the negative consequences of the spring effect because the device 10 utilizes the inertia generated by the inertia member 18 to transmit energy past the connection of the anvil 22 and the device 10. Additionally, there is a spring effect between the device 10 and the fastener. Again, this spring effect stores energy and releases energy. It is again desirable to mitigate the negative consequences of the spring effect because the device 10 utilizes the inertia generated by the inertia member 18 to transmit energy past the connection of the device 10 and fastener.

The purpose of the inertia member 18 is to increase the overall performance of an impact wrench 12, containing a rotary hammer 28, by increasing the net effect of the rotary hammer 28 inside the impact wrench 12. The performance is increased as a result of the inertia member 18 functioning as a type of stationary flywheel on the device 10. Stationary flywheel means the flywheel is stationary relative to the device 10, but moves relative to the anvil 22 and the fastener. By acting as a stationary flywheel, the inertia member 18 increases the amount of torque applied to the fastener for loosening or tightening the fastener.

Figure 8:
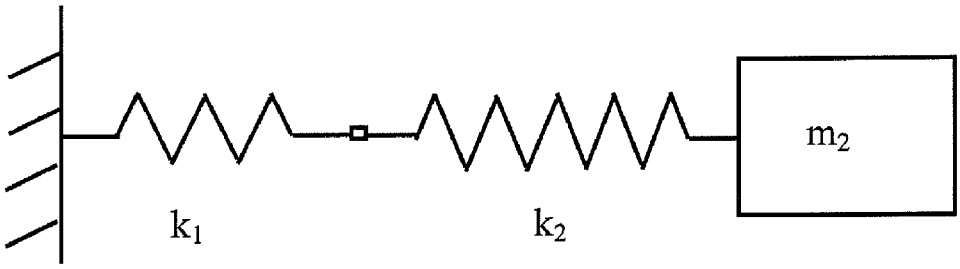
FIG. 8 is a block diagram indicating a standard prior art socket disposed on the anvil of an impact wrench for removing a fastener.

In a prior art application, a standard socket is disposed on the anvil 22 of an impact wrench 12 for removing a fastener, as indicated in FIG. 8. It should be noted that FIG. 8 is shown in a linear system, but the impact wrench 12 and socket is a rotary system. The mass moment of inertia of the impact wrench 12 is designated m.sub.2 and represents the mass moment of inertia of the rotary hammer 28 inside the impact wrench. The spring rate of the anvil 22 and socket connection is represented by k.sub.2. The spring rate of the socket and fastener connection is represented by k.sub.1, and the fastener is represented by ground. As represented in FIG. 8, the combined spring rate of k.sub.1 and k.sub.2, greatly reduces the peak torque delivered by the impact wrench 12 during impact with the fastener. The combined spring rate of k.sub.1 and k.sub.2 allows the mass m.sub.2 to decelerate more slowly, thereby imparting a reduced torque spike.

Figure 9:
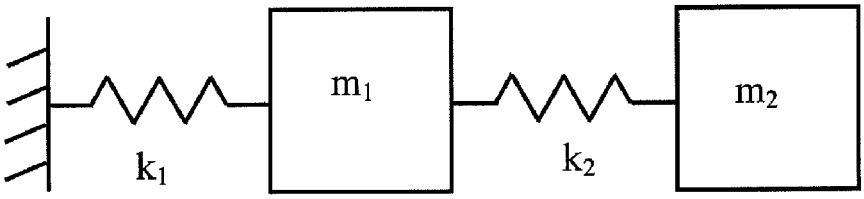
FIG. 9 is block diagram of the present invention indicating an inertia member that adds a substantial mass a large distance from the axis of rotation of the rotary impact device.

In the present application, as illustrated in FIG. 9, the inertia member 18 adds a substantial mass a large distance from the axis of rotation of the rotary impact device 10. Again, it should be noted that FIG. 9 is shown in a linear mode, but the impact wrench and socket is a rotary system. The inertia member 18 of the rotary impact device 10 is represented by m.sub.1. The inertia member m.sub.1 is situated between spring effects k.sub.1 and k.sub.2. The spring rate of the anvil and socket connection is represented by k.sub.2. The spring rate of the socket and fastener connection is represented by k.sub.1, and the fastener is represented by ground. The mass moment of inertia of the impact wrench is designated m.sub.2 and represents the mass moment of inertia of the rotary hammer inside the impact wrench. The spring rate of k.sub.1 is three times that of k.sub.1 and k.sub.2 combined, causing very high torques to be transmitted from the inertia member m.sub.1 to the fastener.

As is known to one of ordinary skill in the art, the combination of two masses (m.sub.1 and m.sub.2) and two springs (k.sub.1 and k.sub.2) is often referred to as a double oscillator mechanical system. In this system, the springs (k.sub.1 and k.sub.2) are designed to store and transmit potential energy. The masses (m.sub.1 and m.sub.2) are used to store and transmit kinetic energy. The double oscillator system can be tuned to efficiently and effectively transfer energy from the impact device (m.sub.2) through k.sub.2, inertia member (m.sub.1) and k.sub.1 and into the fastener. Proper tuning will ensure most of the energy delivered by the impact wrench m.sub.2 is transferred through spring k.sub.2 and into the inertia member 18. During use, the rate of deceleration of mass m.sub.1 is very high since spring k.sub.1 is stiff. Since deceleration is high the torque exerted on the fastener is high.

Figure 5:
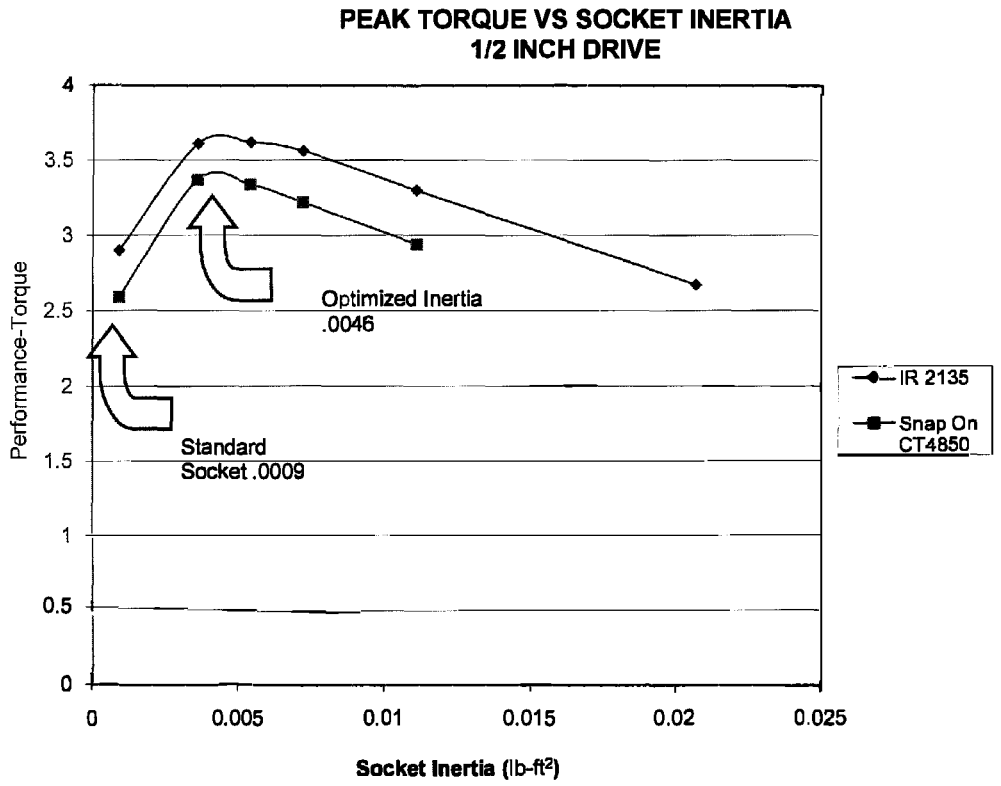
FIG. 5 is a graph charting the torque vs. socket inertia of a prior art socket and the rotary impact device of the present invention to determine the optimized inertia.

The preexisting elements of the double oscillator system are predetermined. The rotary hammer inside the impact wrench m.sub.2 and springs k.sub.1 and k.sub.2 have defined values. For tuning the system, the only value which needs to be determined is the inertia member m.sub.1 (18) of the rotary impact device 10 for achieving optimized inertia. The impact wrench, depending upon the drive size (i.e. ½", ¾", 1"), has a different optimal inertia for each drive size. The spring rate k.sub.2 and the rotary hammer inside the impact wrench m.sub.2 are coincidentally the same for all competitive tools. As illustrated in FIG. 5, the optimal inertia for a ½" drive impact wrench is charted by comparing the performance torque with the socket inertia. A standard socket is charted and the rotary impact device is charted in FIG. 5. As is clearly evidenced in FIG. 5, the rotary impact device 10 of the present invention has a higher torque output than a standard, prior art socket. Additionally, the optimized inertia for a ½" drive impact wrench is 0.0046 lb-ft.sup.2 (1.938 kg-cm.sup.2).

The inertia member 18 may have any configuration that would increase the torque output of the rotary impact device 10. One exemplary embodiment of the inertia member 18 is illustrated in FIGS. 1 and 2. The inertia member 18 has a front surface 30, a top surface 32, and a back surface 34. In this exemplary embodiment, the inertia member 18 contains three-spaced apart bores 36 that extend substantially longitudinally along the inertia member 18. In other words, the three-spaced apart bores 36 extend along the front surface 30 and back surface 34. The three spaced-apart bores 36 extend through the inertia member 18 from the front surface 30 to the back surface 34. The transition from the front surface 30 of the inertia member 18 contains a chamfer 38 that circumscribes the spaced apart bores 36. Although three-spaced apart bores 36 are illustrated in FIG. 1, any number of spaced apart bores 36 may be utilized, or in the alternative, the inertia member 18 may be a solid piece containing no bores 36.

Additionally, the output member 16 contains a beveled outer edge 40. The beveled outer edge 40 allows for easily inserting the fastener into the output recess 26 of the output member 16. When the output member 16 comes in contact with the fastener for forming a selectively secured arrangement, the beveled outer edge 40 of the output recess 26 aids in guiding the fastener into the output recess 26.

Figure 6:
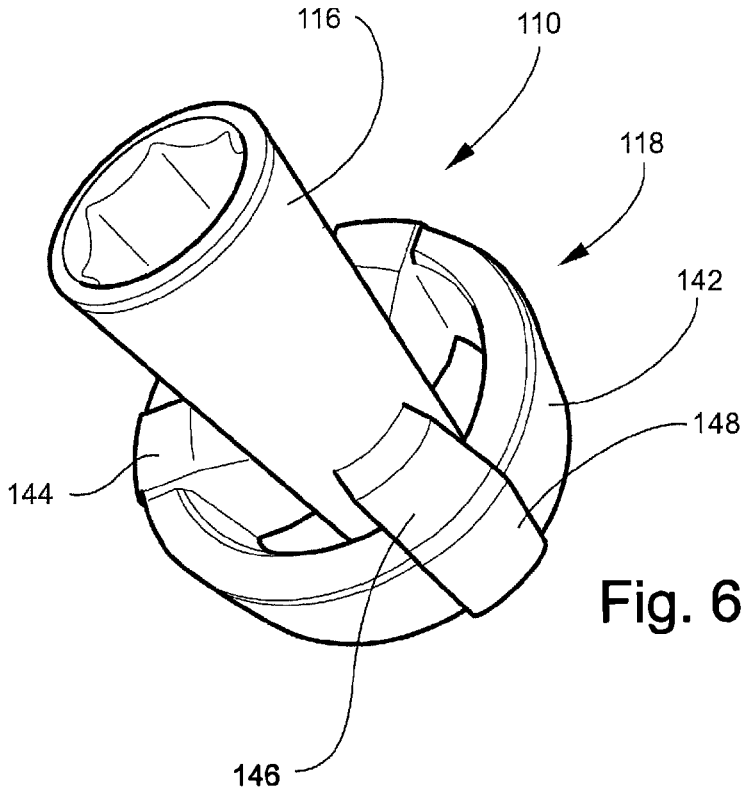
FIG. 6 is a perspective view of another embodiment of the rotary impact device.

Another exemplary embodiment of the rotary impact device is shown in FIG. 6 as is referred to generally as reference number 110 including an output member 116. The inertia member 118 of this exemplary embodiment has a ring 142, which may be solid, containing three (3) ribs 144 for keeping the ring 142 stationary and engaged to the exterior surface of the device 110. The three ribs 144 are engaged to the exterior surface of the device 110 for positioning the ring 142 in a spaced apart relationship with the device 110. The ribs 144 extend radially outward from the exterior surface of the device 110 and include a collar 146 prior to the rib 144 engaging the ring 142. The rib 144 extends slightly beyond the front surface 130, top surface, 132, and back surface 134 of the ring 142 forming a step 148 upon these surfaces (130,132,134) of the ring 140.

Figure 7:
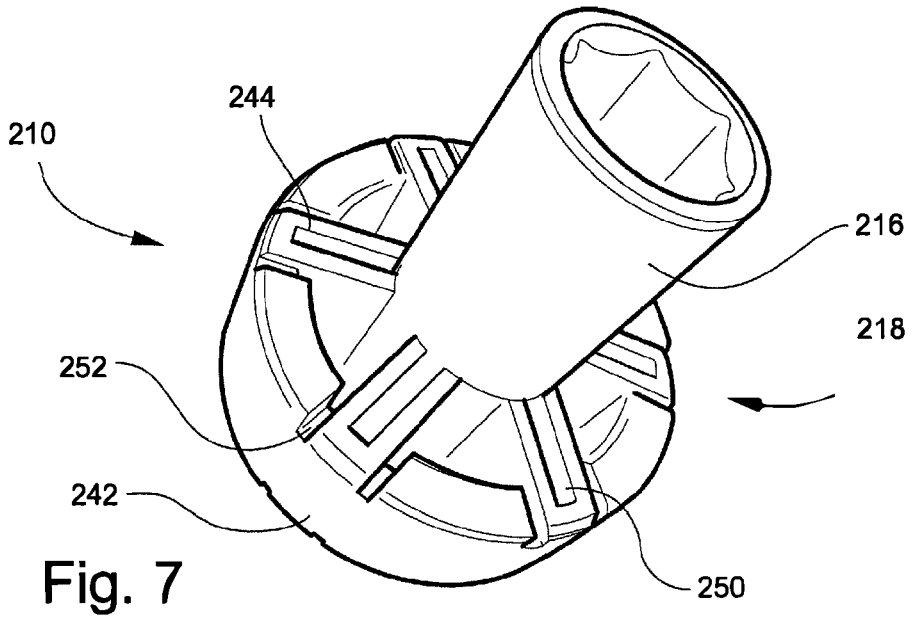
FIG. 7 is a perspective view of another embodiment of the rotary impact device.

Another exemplary embodiment of the rotary impact device is shown in FIG. 7 and is referred to generally as reference number 210 including an output member 216. The inertia member 218 of this exemplary embodiment is a ring 242 containing five (5) ribs 244. The ribs 244 keep the ring 244 stationary and engaged to the exterior surface of the device 210. The five (5) ribs 244 are engaged to the exterior surface of the device 210 for positioning the ring 244 in a spaced apart relationship with the device 210. The ribs 244 extend radially outward from the exterior surface of the device 210 and include an inset 250 within the interior of each rib 244. A shelf 252 is positioned on the front surface 230 of the ring 242 for receiving each rib 244. Likewise, a shelf 252 may be positioned on the back surface 234 of the ring 242 for receiving each rib 244.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A rotary impact device for use with an impact wrench, the device comprising:

an input member shaped to selectively securely engage and receive energy from an anvil of an impact wrench, wherein the anvil receives energy when impacted by a hammer of an impact wrench, and further wherein there is a distinct anvil spring rate associated with the engagement of the input member with the anvil;

an output member shaped to selectively securely engage a fastener and transfer energy received from the anvil to the fastener, wherein there is a distinct fastener spring rate associated with the engagement of the output member with the fastener, and wherein the engagement of the fastener with the output member is more stiff than the engagement of the anvil with the input member, so that the fastener spring rate is higher than the anvil spring rate; and an inertial member situated between the input member and the output member, wherein the inertial member is tuned in accordance with a double-oscillator system to achieve an optimized inertia, so that the configuration of the inertial member ensures that most of the energy delivered by the hammer to the anvil upon impact is then transferred through the engagement of the anvil with the input member and into the inertial member, and then most of the energy of the inertial member is transferred through the engagement of the output member with the fastener member.

2. The device of claim 1, wherein the tuned inertial member is optimized to increase the net effect of the rotary hammer inside the impact wrench.

3. The device of claim 1, wherein depending upon the size of the output member, the inertial member has a different optimal inertia for each output member size.

4. The device of claim 3, wherein the output torque of the device is higher than a standard socket having a similarly sized output drive member.

5. The device of claim 1, wherein the distinct fastener spring rate alone is at least three times that of the distinct anvil spring rate combined with the distinct fastener spring rate permitting very high torques to be transmitted from the inertia member to the fastener.

6. The device of claim 1, wherein the inertial member is a solid piece.

7. A method of increasing torque delivered to a fastener by an impact wrench through a socket, the method comprising:

providing an impact wrench having a hammer configured to impact an anvil of the impact wrench, wherein the inertial mass of the hammer is predetermined;

providing a socket, wherein the socket is configured to engage the anvil of the impact wrench in a manner permitting transfer of kinetic energy from the hammer to the socket, and wherein a spring rate associated with the connection of the anvil with the socket is predetermined;

providing a fastener configured to engage the socket, wherein a spring rate associated with the connection of the socket with the fastener is predetermined; and optimizing the inertial mass of the socket, wherein the socket is provided with an inertial member that is tuned and configured to efficiently and effectively transfer energy from the hammer of the impact wrench, through the anvil and socket connection, in a manner ensuring that most of the energy delivered by the hammer is transferred into the socket and stored, so that, during use of the impact wrench upon a fastener, the socket decelerates at a high rate as stored energy is transferred from the socket and increased torque is delivered to the fastener.

8. The method of claim 7, wherein the spring rate associated with the connection of the socket with the fastener is at least three times the combined spring rate of the connection of the socket with the fastener and the connection of the anvil with the socket.

9. The method of claim 7, wherein the tuned socket is optimized to maximize the net effect of the rotary hammer inside the impact wrench.

10. The method of claim 7, wherein the output torque of the tuned and optimized socket is substantially higher than a standard socket having a similarly sized output drive member.

11. The method of claim 7, wherein the optimized socket is a solid piece containing no external bores.

12. The method of claim 7, wherein inertial optimization of the socket involves application of tuning a double-oscillator system.

13. The method of claim 12, wherein the inertial mass of the hammer is associated with a mass m2 in the double oscillator system, and further wherein the inertial mass of the socket is associated with a mass m1 in the double oscillator mechanical system.

14. The method of claim 13, wherein a spring effect of a connection of the anvil to the socket is associated with a spring rate k2 in the double oscillator system, and further wherein a spring effect of a connection of the socket to the fastener is associated with a spring rate k1 in the double oscillator mechanical system.

15. A method of tuning a socket to optimize the net effect of torque delivered to a fastener by an impact wrench through the socket, the method comprising:

representing an inertial mass of a hammer of an impact wrench with a mass m2 in a double oscillator mechanical system, wherein the hammer is configured to store and transmit kinetic energy to an anvil of the impact wrench when the hammer contact impacts the anvil;

representing a spring effect of a connection of the anvil to a socket with a spring rate k2 in the double oscillator system, wherein the anvil and socket connection stores and transmits potential energy into the socket;

representing an inertial mass of the socket with a mass m1 in the double oscillator mechanical system, wherein the socket is configured to transmit energy to a fastener;

representing a spring effect of a connection of the socket to the fastener with a spring rate k1 in the double oscillator mechanical system, wherein the socket and fastener connection stores and transmits potential energy into the fastener;

representing the fastener by ground in the double oscillator mechanical system;

identifying preexisting and defined values for m2, k2 and k1 in the double oscillator system; and determining an optimal inertial mass m1 of the socket, to ensure most of the energy delivered by the hammer is transferred to the socket before the socket transfers energy to the fastener.

16. The method of claim 15, wherein the tuned socket is optimized to maximize the net effect of the rotary hammer inside the impact wrench.

17. The method of claim 15, wherein the output torque of the tuned and optimized socket is substantially higher than a standard socket having a similarly sized output drive member.

18. The method of claim 15, wherein depending upon the size of an output member of the socket, there is a different determined optimal inertial mass m1 associated with each output member size.

19. The method of claim 15, wherein the determined optimized inertial mass m1 of the socket includes a portion of the socket that extends transversely out from a center axis of the socket, so as to define a ring component having a radius that is larger than a radius of an outer surface of the rest of the socket.

20. The method of claim 15, wherein the optimized socket is a solid piece containing no external bores.

* * * * *